US005242515A

United States Patent [19]

Worcester et al.

[11] Patent Number: 5,242,515

[45] Date of Patent: Sep. 7, 1993

[54] ZIRCALOY-4 ALLOY HAVING UNIFORM AND NODULAR CORROSION RESISTANCE

[75] Inventors: Samuel A. Worcester, Butte, Mont.; James P. Dougherty, Hooper, Utah; John P. Foster, Monroeville, Pa.

[73] Assignee: Westinghouse Electric Corp., Pittsburgh, Pa.

[21] Appl. No.: 933,263

[22] Filed: Aug. 21, 1992

Related U.S. Application Data

[62] Division of Ser. No. 494,638, Mar. 16, 1990, Pat. No. 5,194,101.

[51] Int. Cl.[5] ..... C22C 16/00

[52] U.S. Cl. ..... 148/672; 420/422

[58] Field of Search ..... 148/672; 420/422

[56] References Cited

U.S. PATENT DOCUMENTS

| | | | |
|---|---|---|---|
| 4,908,071 | 3/1990 | Anderson et al. | 148/672 |
| 4,981,527 | 1/1991 | Charquet | 148/672 |
| 4,992,240 | 2/1991 | Komatsu et al. | 148/672 |

*Primary Examiner*—Upendra Roy
*Attorney, Agent, or Firm*—J. C. Valentine

[57] ABSTRACT

This is an improved method of fabricating Zircaloy-4 strip. The method is of the type wherein Zircaloy-4 material is vacuum melted, forged, hot reduced, beta-annealed, quenched, hot rolled, subjected to a post-hot-roll anneal and then reduced by at least two cold rolling steps, including a final cold rolling to final size, with intermediate annealing between the cold rolling steps and with a final anneal after the last cold rolling step. The improvement comprises: (a) utilizing a maximum processing temperature of 620° C. between the quenching and the final cold rolling to final size; (b) utilizing a maximum intermediate annealing temperature of 520° C.; and (c) utilizing hot rolling, post-hot-roll annealing, intermediate annealing and final annealing time-temperature combinations to give an A parameter of between $4\times10^{-19}$ and $7\times10^{-18}$ hour, where segment parameters are calculated for the hot rolling step and each annealing step, the segment parameters are calculated by taking the time, in hours, for which that step is performed, to the (−40,000/T) power, in which T is the temperature, in degrees K, at which the step is performed, and where the A parameter is the sum of the segment parameters. Preferably, the hot rolling and the post-hot-roll anneal are at 560°-620° C. and are for 1.5-3 hours and the intermediate annealing is at 400°-520° C. and is for 1.5-15 hours and the final anneal after the last cold rolling step is at 560°-710° C. for 1-5 hours, and the beta-anneal is at 1015°-1130° C. for 2-30 minutes.

5 Claims, 3 Drawing Sheets

ZIRCALOY-4 ALLOY HAVING UNIFORM AND NODULAR CORROSION RESISTANCE

This is a division of application Ser. No. 07/494,638 filed Mar. 16, 1990 now U.S. Pat. No. 5,194,101.

CROSS REFERENCE TO RELATED APPLICATIONS

This application is related to U.S. Pat. No. 5,125,985, issued Jun. 30, 1992 "ZIRLO Material Composition and Fabrication Processing" and assigned to the same assignee. That Patent provides a method of controlling creep in zirconium-niobium-tin-iron alloys by means of process variations.

This application is related to U.S. Pat. No. 5,112,573, issued May 12, 1992, entitled "ZIRLO Material for Light Water Reactor Applications" and assigned to the same assignee. That Patent provides composition ranges for maintaining corrosion resistance while allowing recycling of Zircaloy-4 and Zircaloy-2 material.

BACKGROUND OF THE INVENTION

The invention relates to a zirconium based material and more particularly to methods for improved corrosion resistance of Zircaloy-4 strip material (as opposed to other alloys or to Zircaloy-4 tubing).

In the development of nuclear reactors, such as pressurized water reactors and boiling water reactors, fuel designs impose significantly increased demands on all of the core strip and tubular cladding (strip is used for grids, guide tubes, and the like). The corrosion of strip is somewhat different from that of cladding as the two have quite different texture (strip is rolled, while cladding is pilgered). Such components are conventionally fabricated from the zirconium-based alloys, Zircaloy-2 and Zircaloy-4. Increased demands on such components will be in the form of longer required residence times and thinner structural members, both of which cause potential corrosion and/or hydriding problems.

Commercial reactors generally use either Zircaloy-2 or Zircaloy-4, (see U.S. Pat. Nos. 2,772,964 and 3,148,055). Zircaloy-2 is a zirconium alloy having about 1.2–1.7, weight percent (all percents herein are weight percent) tin, 0.07–0.20 percent iron, about 0.05–0.15 percent chromium, and about 0.03–0.08 percent nickel. Zircaloy-4 contains about 1.2–1.7 percent tin, about 0.18–0.24 percent iron, and about 0.07–0.13 percent chromium.

Fabrication schedules for Zircaloy-4 have been developed with regard to corrosion resistance. Generally, different processing methods result in either good uniform or good nodular corrosion resistance but not both. The effect of thermal treatment variations has been accounted for by the cumulative A-parameter (see Steinberg, et al. "Zirconium in the Nuclear Industry: Sixth International Symposium, ASTM STP 824, American Society for Testing and Materials, Philadelphia, 1984). Charquet, et al. (see D. Charquet, et al. "Influence of Variations in Early Fabrication Steps on Corrosion, Mechanical Properties and Structures of Zircaloy-4 Products", Zirconium in the Nuclear Industry Seventh International Symposium, ASTM, STP 939, ASTM, 1987, pp. 431–447) investigated the effects of early stage tube processing on uniform (400° C.) and nodular (500° C.) corrosion. Charquet's results showed that, with increasing cumulative A-parameter, nodular corrosion increases, but that uniform corrosion decreases.

SUMMARY OF THE INVENTION

This is an improved method of fabricating Zircaloy-4 strip. The method is of the type wherein Zircaloy-4 material is vacuum melted, forged, hot reduced, beta-annealed, quenched, hot rolled, subjected to a post-hot-roll anneal and then reduced by at least two cold rolling steps, including a final cold rolling to final size, with intermediate annealing between the cold rolling steps and with a final anneal after the last cold rolling step. The improvement comprises: (a) utilizing a maximum processing temperature of 620° C. between the quenching and the final cold rolling to final size; (b) utilizing a maximum intermediate annealing temperature of 520° C.; and (c) utilizing hot rolling, post-hot-roll annealing, intermediate annealing and final annealing time-temperature combinations to give an A parameter of between $4\times10^{-19}$ and $7\times10^{-18}$ hour, where segment parameters are calculated for the hot rolling step and each annealing step, the segment parameters are calculated by taking the time, in hours, for which that step is performed, to the (−40,000/T) power, in which T is the temperature, in degrees K, at which the step is performed, and where the A parameter is the sum of the segment parameters.

Preferably, the hot rolling and the post-hot-roll anneal are at 560°–620° C. and the intermediate annealing is at 400°–520° C. and the final anneal after the last cold rolling step is at 560°–710° C.

Preferably, the hot rolling and the post-hot-roll anneal are for 1.5–3 hours and the intermediate annealing is for 1.5–15 hours and the final anneal after the last cold rolling step is for 1–5 hours, and the beta-anneal is at 1015°–1130° C. for 2–30 minutes.

BRIEF DESCRIPTION OF THE DRAWINGS

The invention as set forth in the claims will become more apparent by reading the following detailed description in conjunction with the accompanying drawing, in which:

DETAILED DESCRIPTION OF THE INVENTION

Figure 1:
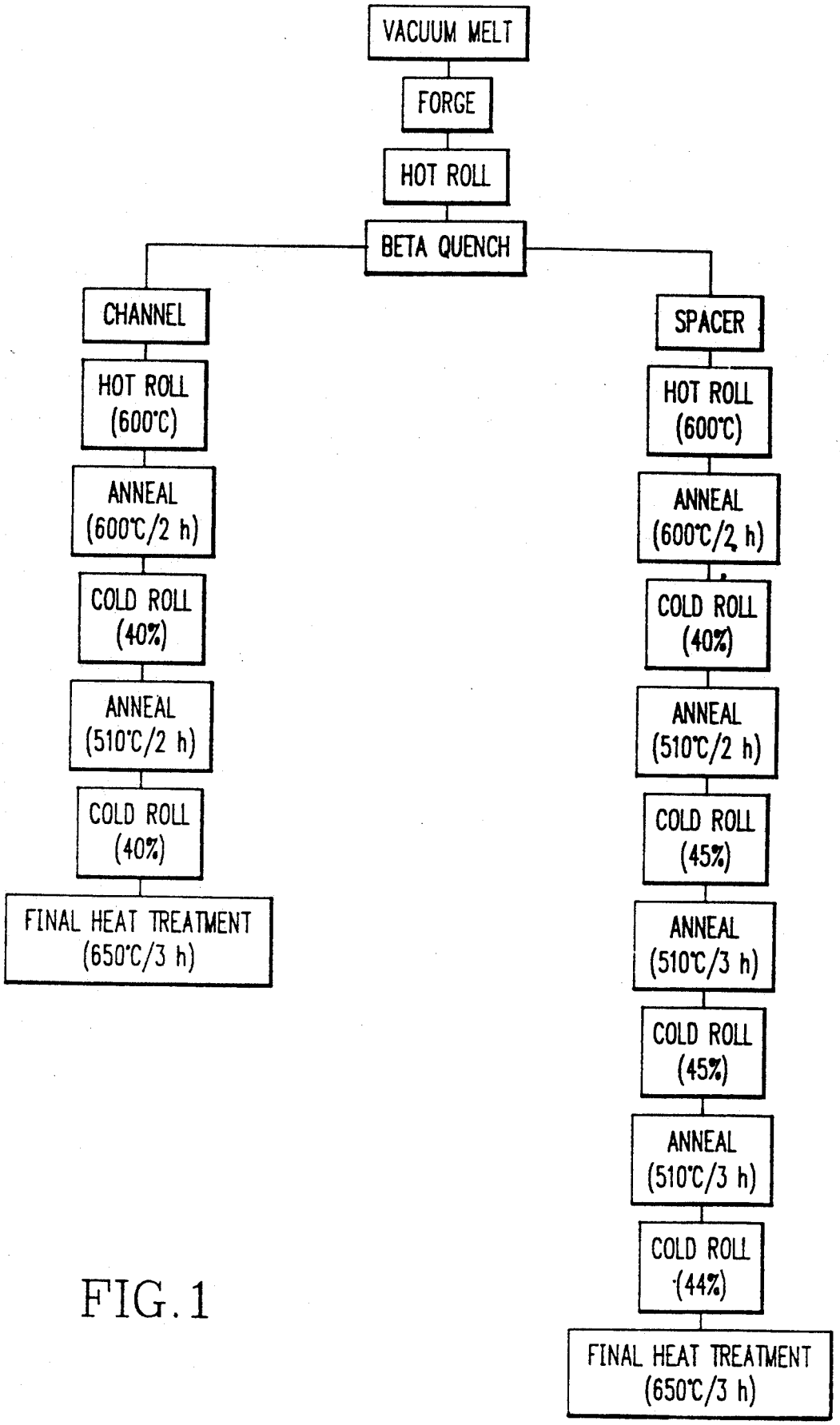
FIGS. 1 and 2 schematically outline two embodiments of the processing sequence.

The current process sequence is schematically outlined in FIG. 1. Beta quenching is performed by fluidized bed annealing in the temperature range of 1015° C. to 1130° C. for 2 to 30 minutes followed by water quenching. Hot rolling and the subsequent recrystallization anneal are performed at 600° C. Stress relief anneals are used between cold rolling sequences. The final recrystallization anneal is performed at 650° C. for 3 hours. This process sequence results in a value of the cumulative A-parameter in the range between $4\times10^{-19}$ and $7\times10^{-18}$ hours.

Figure 2:
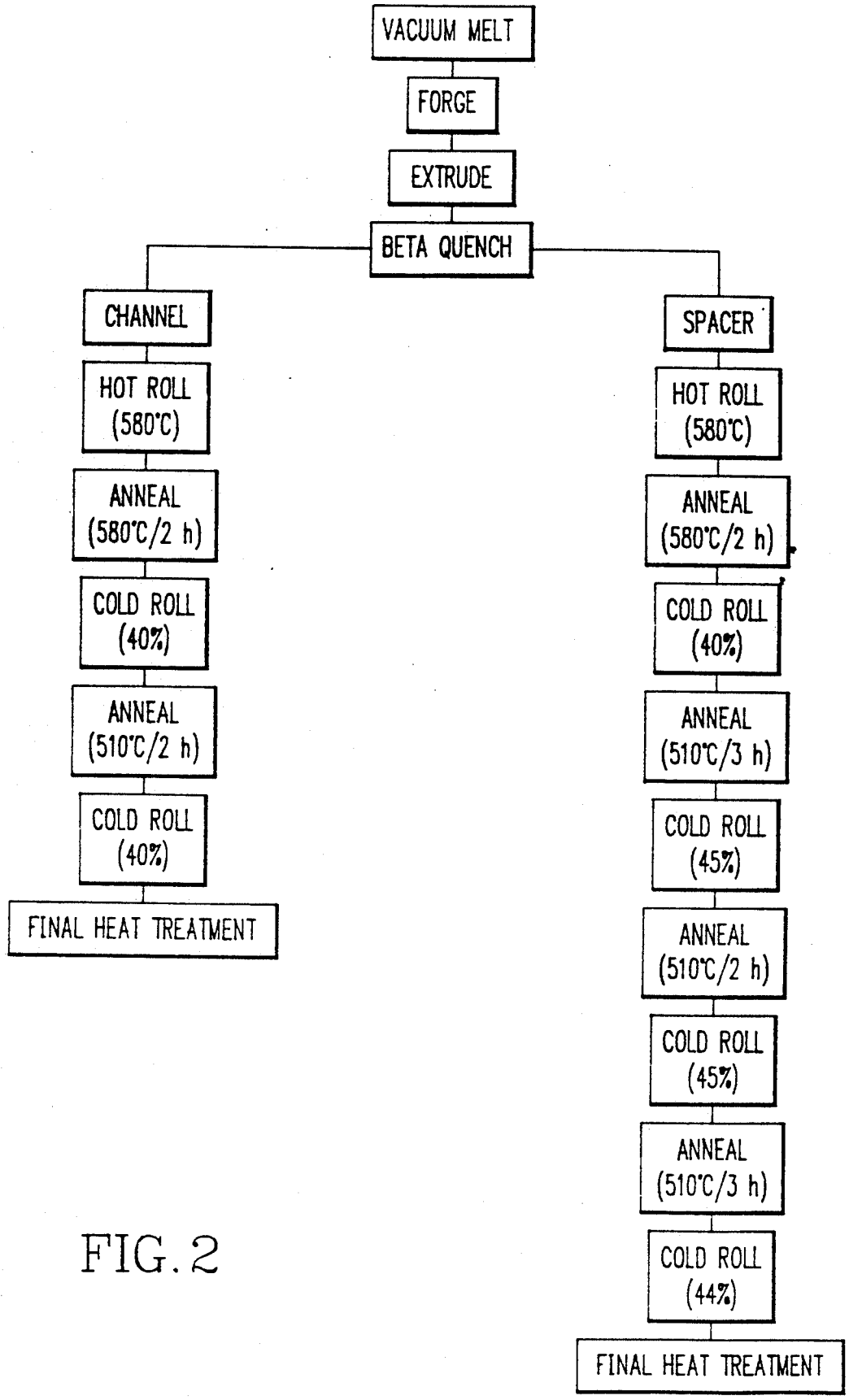

Zircaloy-4 was processed according to the process outline in FIG. 2. Beta quenching was performed by induction heating a large diameter hollow cylinder to 1093° C. for 4 minutes and water quenching. Hot rolling and the subsequent recrystallization anneal were performed at 580° C. Stress relief anneals were used between cold rolling sequences to produce final size spacer and channel strip. Nodular corrosion tests were performed at 500° C. in a static autoclave for 1 day.

Figure 3A:
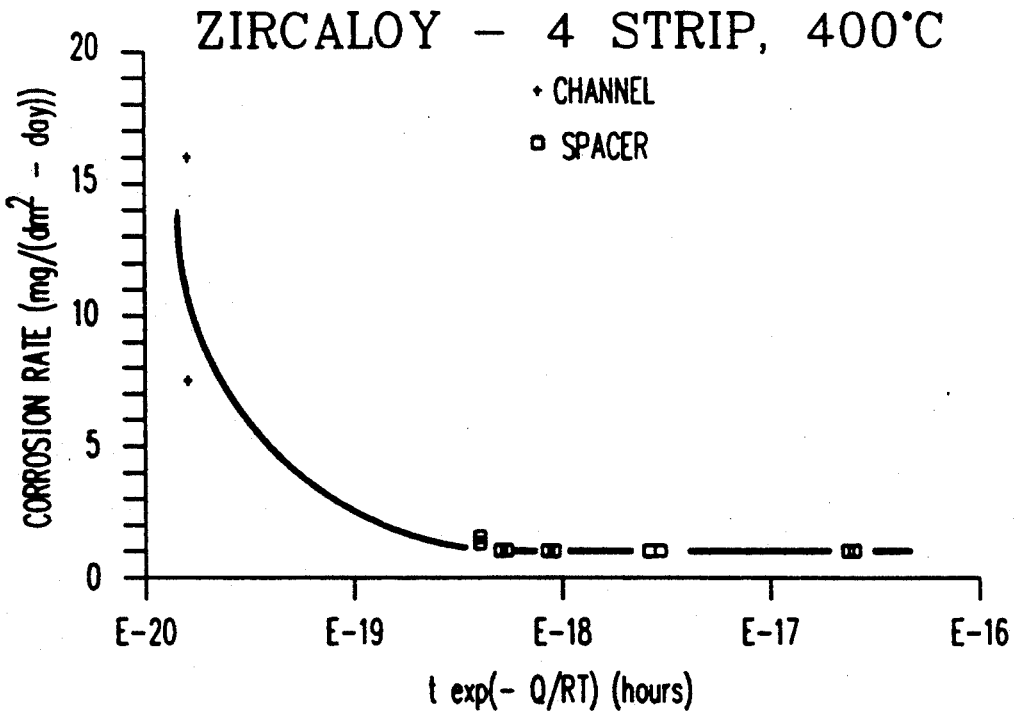
FIGS. 3*a* and 3*b* show corrosion test results at 400° C. and 500° C. respectively.

Uniform steam corrosion tests were performed at 400° C. for exposure times of 3 to 88 days. The results are presented in FIG. 3*a*.

Figure 3B:
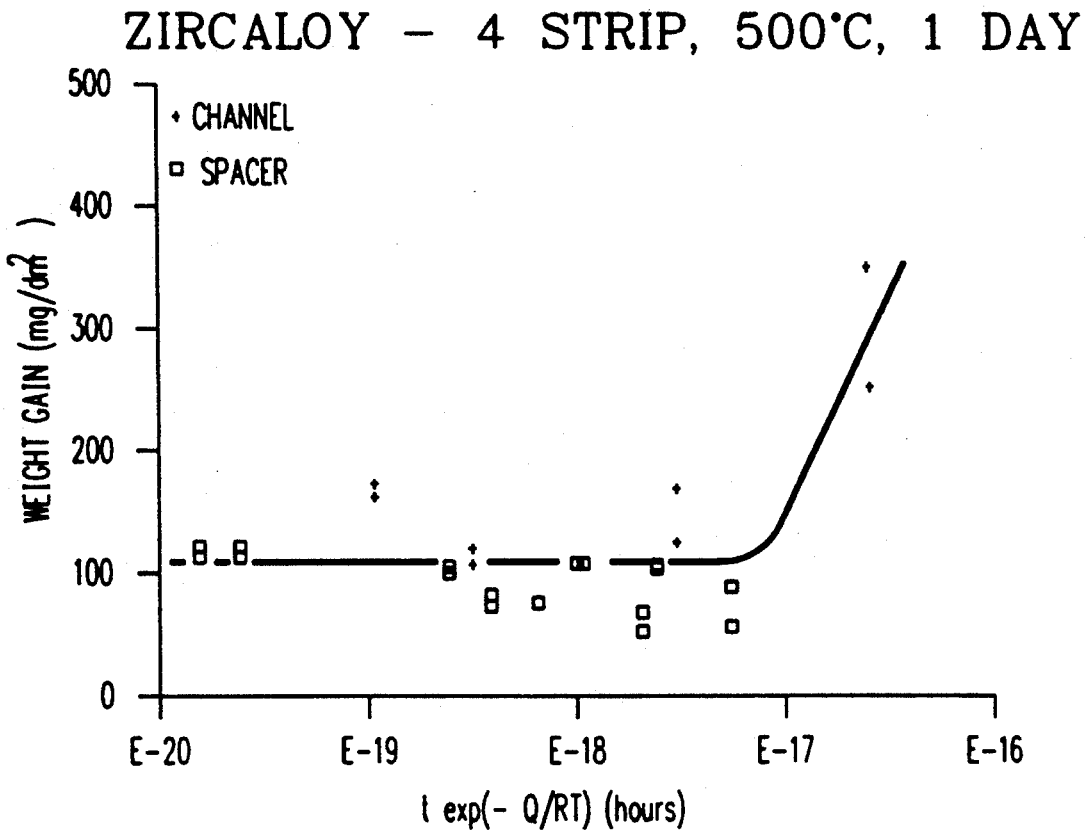

Maximum uniform (400° C.) and nodular (500° C., FIG. 3B) corrosion resistance was obtained using the process sequence in FIG. 2 and controlling the final recrystallization anneal. FIG. 3 shows that maximum uniform and nodular corrosion resistance were obtained when the cumulative A-parameter was in the range of $4\times10^{-19}$ to $7\times10^{-18}$ hour.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

We claim:

1. A zirconium alloy strip having:

a composition comprising, by weight percent, about 1.2–1.7% Sn, about 0.18–0.24% Fe, about 0.07–0.13% Cr, and balance substantially zirconium; and having a uniform corrosion rate at 400° C. of less than 2 mg/dm/day and a modular corrosion rate after one day at 500° C. of less than 100 mg/dm$^2$.

2. A zirconium alloy strip having:

a composition comprising, by weight percent;

about 1.2–1.7% Sn, about 0.18–0.24% Fe, about 0.07–0.13% Cr, and balance substantially zirconium; and fabricated by a thermomechanical process including vacuum melting, forging, hot reducing, beta-annealing, quenching, hot rolling, post-hot rolling annealing, intermediately cold rolling in at least two steps and intermediately annealing after the intermediate cold rolling steps, and cold rolling in a final cold rolling step and final annealing after the final cold working step, wherein a. the maximum processing temperature of the zirconium alloy during the hot rolling, post-hot rolling annealing and intermediate cold rolling steps is 620° C., b. the maximum intermediate annealing temperature between the cold rolling steps is 520° C. for stress relieving the zirconium alloy, and c. the hot rolling, post-hot rolling annealing, intermediate annealing and final annealing time-temperature combinations give an A-parameter of between $4\times10^{-19}$ and $7\times10^{-18}$ hour, where segment parameters are calculated for the hot rolling step and each annealing step, said segment parameters being calculated by mutliplying the time, in hours, for which that step is performed, by the exponential of (−40,000/T), in which T is the temperature, in degrees K, at which the step is performed, and where the A parameter is the sum of the segment parameters.

3. The strip of claim 2, wherein the zirconium alloy is hot rolled and post-hot roll annealed at 560°–620° C., intermediately annealed between the cold rolling steps at 400°–520° C. and final annealed after the last cold rolling step at 560°–710° C.

4. The strip of claim 3, wherein the hot rolling and post-hot rolling annealing are for 1.5–3 hours and the intermediate annealing between cold rolling steps is for 1.5–15 hours and the final anneal after the last cold rolling step is for 1–5 hours.

5. The strip of claim 3, wherein the beta-anneal is at 1015°–1030° C. for 2–30 minutes.

* * * * *